US008020627B2

(12) United States Patent
Shahin et al.

(10) Patent No.: US 8,020,627 B2
(45) **Date of Patent: *Sep. 20, 2011**

(54) EQUALIZED LOAD DISTRIBUTION SLIPS FOR SPIDER AND ELEVATOR

(75) Inventors: David Shahin, Houston, TX (US); Karsten Heidecke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/688,674

(22) Filed: Jan. 15, 2010

(65) Prior Publication Data

US 2010/0108330 A1 May 6, 2010

Related U.S. Application Data

(63) Continuation of application No. 11/382,550, filed on May 10, 2006, now Pat. No. 7,686,088.

(60) Provisional application No. 60/680,204, filed on May 12, 2005, provisional application No. 60/689,199, filed on Jun. 9, 2005.

(51) Int. Cl.
*E21B 23/00* (2006.01)
*E21B 19/10* (2006.01)

(52) U.S. Cl. ..... 166/382; 175/423

(58) Field of Classification Search ..... 403/367, 403/374.1; 77/51, 52; 75/14; 166/382; 175/423
See application file for complete search history.

(56) References Cited

U.S. PATENT DOCUMENTS

| | | | |
|---|---|---|---|
| 1,469,894 | A | 10/1923 | Clarke |
| 1,541,669 | A | 6/1925 | Summers |
| 1,794,273 | A | 2/1931 | Black |
| 1,983,545 | A | 12/1934 | Johnson |
| 2,061,772 | A | 11/1936 | McLagan |
| 2,063,361 | A | 12/1936 | Baash |
| 2,298,507 | A | 10/1942 | Penick et al. |
| 2,410,589 | A | 11/1946 | Segelhorst |
| 2,563,851 | A | 8/1951 | Lundeen et al. |
| 2,589,159 | A | 3/1952 | Stone |
| 2,934,148 | A | 4/1960 | Allaire |
| 3,052,943 | A | 9/1962 | Jones |

(Continued)

FOREIGN PATENT DOCUMENTS

| | | |
|---|---|---|
| CA | 2 284 428 | 4/2001 |

(Continued)

OTHER PUBLICATIONS

EP Search Report for Application No. 10174610.5—2315/2256286 dated Jan. 17, 2011.

(Continued)

*Primary Examiner* — David J Bagnell
*Assistant Examiner* — Sonya Bible
(74) *Attorney, Agent, or Firm* — Patterson & Sheridan, LLP

(57) ABSTRACT

Embodiments of the present invention generally relate to an apparatus for supporting a tubular that more evenly distributes stress along the contact length of a tubular. In one embodiment, an apparatus for supporting a tubular is provided. The apparatus includes a bowl having a longitudinal opening extending therethrough and an inner surface for receiving a gripping member. The gripping member is movable along the surface of the bowl for engaging the tubular. The apparatus is configured so that an upper portion of the gripping member will engage the tubular before the rest of the gripping member engages the tubular.

32 Claims, 7 Drawing Sheets

U.S. PATENT DOCUMENTS

| | | | |
|---|---|---|---|
| 3,188,708 | A | 6/1965 | O'Haver |
| 3,287,776 | A | 11/1966 | Brown |
| 3,330,354 | A | 7/1967 | Chamblee |
| 3,334,923 | A | 8/1967 | Putch |
| 3,579,752 | A | 5/1971 | Brown |
| 3,675,278 | A | 7/1972 | Powell |
| 3,722,603 | A | 3/1973 | Brown |
| 3,748,702 | A | 7/1973 | Brown |
| 4,203,182 | A | 5/1980 | Boyadjieff et al. |
| 4,332,062 | A | 6/1982 | Byrne, Jr. |
| 4,354,706 | A | 10/1982 | Coyle, Sr. |
| 4,381,584 | A | 5/1983 | Coyle, Sr. |
| 4,523,645 | A | 6/1985 | Moore |
| 4,579,379 | A | 4/1986 | Berg |
| 4,600,054 | A | 7/1986 | Miller et al. |
| 4,643,259 | A | 2/1987 | Zeringue, Jr. |
| 4,715,456 | A | 12/1987 | Poe, Jr. et al. |
| 4,823,919 | A | 4/1989 | Hayatdavoudi |
| 4,867,236 | A | 9/1989 | Haney et al. |
| 5,335,756 | A | 8/1994 | Penisson |
| 5,484,040 | A | 1/1996 | Penisson |
| 5,595,248 | A | 1/1997 | Denny |
| 5,609,226 | A | 3/1997 | Penisson |
| 5,848,647 | A | 12/1998 | Webre et al. |
| 6,089,338 | A | 7/2000 | Bouligny, Jr. |
| 6,192,981 | B1 | 2/2001 | Boquet et al. |
| 6,237,684 | B1 | 5/2001 | Bouligny, Jr. et al. |
| 6,264,395 | B1 | 7/2001 | Allamon et al. |
| 6,349,764 | B1 | 2/2002 | Adams et al. |
| 6,364,012 | B1 | 4/2002 | Adams et al. |
| 6,378,399 | B1 | 4/2002 | Bangert |
| 6,378,614 | B1 | 4/2002 | Adams et al. |
| 6,536,520 | B1 | 3/2003 | Snider et al. |
| 6,595,288 | B2 | 7/2003 | Mosing et al. |
| 6,640,939 | B2 | 11/2003 | Buck |
| 6,644,413 | B2 | 11/2003 | Adams et al. |
| 6,668,684 | B2 | 12/2003 | Allen et al. |
| 6,845,814 | B2 | 1/2005 | Mason et al. |
| 6,892,835 | B2 | 5/2005 | Shahin et al. |
| 6,920,931 | B1 | 7/2005 | Webre et al. |
| 7,025,147 | B2 | 4/2006 | Adams et al. |
| 7,032,690 | B2 | 4/2006 | Ramey et al. |
| 7,096,948 | B2 | 8/2006 | Mosing et al. |
| 7,134,531 | B2 | 11/2006 | Ramey et al. |
| 7,267,168 | B1 | 9/2007 | Sipos |
| 7,686,088 | B2 | 3/2010 | Shahin |
| 2001/0053309 | A1 | 12/2001 | Allamon et al. |
| 2002/0074132 | A1 | 6/2002 | Juhasz et al. |
| 2003/0116326 | A1 | 6/2003 | Dallas |
| 2003/0164276 | A1 | 9/2003 | Snider et al. |
| 2003/0173073 | A1 | 9/2003 | Snider et al. |
| 2003/0173117 | A1 | 9/2003 | Mason et al. |
| 2004/0003490 | A1 | 1/2004 | Shahin et al. |
| 2004/0016575 | A1 | 1/2004 | Shahin et al. |
| 2004/0144547 | A1 | 7/2004 | Koithan et al. |
| 2004/0207223 | A1 | 10/2004 | Bee et al. |
| 2004/0251050 | A1 | 12/2004 | Shahin et al. |
| 2004/0251055 | A1 | 12/2004 | Shahin et al. |
| 2005/0000691 | A1 | 1/2005 | Giroux et al. |
| 2005/0056420 | A1 | 3/2005 | Ramey et al. |
| 2006/0102337 | A1 | 5/2006 | Elliott et al. |

FOREIGN PATENT DOCUMENTS

| | | |
|---|---|---|
| DE | 43 26 298 | 3/1995 |
| DE | 19814 033 | 10/1999 |
| FR | 2 658 972 | 8/1991 |
| GB | 915683 | 1/1963 |
| GB | 1 224 258 | 3/1971 |
| GB | 2 014 215 | 8/1979 |
| GB | 2 355 030 | 4/2001 |
| WO | WO 90/04698 | 5/1990 |
| WO | WO 98/21443 | 5/1998 |
| WO | WO 01/69034 | 9/2001 |
| WO | WO 03/031243 | 4/2003 |
| WO | WO 03/031766 | 4/2003 |

OTHER PUBLICATIONS

EP Search Report for Application No. EP 10174610 dated Apr. 12, 2011.

EQUALIZED LOAD DISTRIBUTION SLIPS FOR SPIDER AND ELEVATOR

CROSS-REFERENCE TO RELATED APPLICATIONS

This application is a continuation of U.S. patent application Ser. No. 11/382,550, filed May 10, 2006 now U.S. Pat. No. 7,686,088, which claims benefit of U.S. Provisional Patent Application No. 60/680,204, filed May 12, 2005, and U.S. Provisional Patent Application No. 60/689,199, filed Jun. 9, 2005. The above-referenced applications are hereby incorporated by reference in their entirety.

U.S. patent application Ser. No. 10/207,542, entitled "FLUSH MOUNTED SPIDER"), filed Jul. 29, 2002 is hereby incorporated by reference.

U.S. patent application Ser. No. 10/625,840, entitled "APPARATUS AND METHODS FOR TUBULAR MAKEUP INTERLOCK"), filed Jul. 23, 2003, is herein incorporated by reference.

U.S. patent application Ser. No. 10/794,797, entitled "METHOD AND APPARATUS FOR DRILLING WITH CASING"), filed Mar. 5, 2004, is herein incorporated by reference.

BACKGROUND OF THE INVENTION

1. Field of the Invention

Embodiments of the present invention generally relate to an apparatus for supporting a tubular.

2. Description of the Related Art

The handling and supporting of tubular pipe strings has traditionally been performed with the aid of a wedge shaped members known as slips. In some instances, these members operate in an assembly known as an elevator or a spider. Typically, an elevator or a spider includes a plurality of slips circumferentially surrounding the exterior of the pipe string. The slips are housed in what is commonly referred to as a "bowl". The bowl is regarded to be the surfaces on the inner bore of the spider, an elevator, or another tubular-supporting device. The inner sides of the slips usually carry teeth formed on hard metal dies for engaging the pipe string. The exterior surface of the slips and the interior surface of the bowl have opposing engaging surfaces which are inclined and downwardly converging. The inclined surfaces allow the slip to move vertically and radially relative to the bowl. In effect, the inclined surfaces serve as wedging surfaces for engaging the slip with the pipe. Thus, when the weight of the pipe is transferred to the slips, the slips will move downward with respect to the bowl. As the slips move downward along the inclined surfaces, the inclined surfaces urge the slips to move radially inward to engage the pipe. In this respect, this feature of the spider is referred to as "self tightening." Further, the slips are designed to prohibit release of the pipe string until the pipe load is supported and lifted by another device.

In the makeup or breakup of pipe strings, the spider is typically used for securing the pipe string in the wellbore at a rig floor. Additionally, an elevator suspended from a rig hook includes a separately operable set of slips and is used in tandem with the spider. The elevator may include a self-tightening feature similar to the one in the spider. In operation, the spider holds the tubular string at an axial position while the elevator positions a new pipe section above the pipe string for connection. After completing the connection, the elevator pulls up on and bears the weight of the string thereby releasing the pipe string from the slips of the spider therebelow. The elevator then lowers the pipe string into the wellbore.

Before the pipe string is released from the elevator, the spider is allowed to engage the pipe string again to support the pipe string. After the weight of the pipe string is switched back to the spider, the elevator releases the pipe string and continues the makeup or break out process for the next joint.

Slips are also historically used in a wellbore to retain the weight of tubular strings and aid in locating and fixing tubular strings at a predetermined location in a wellbore. Packers, liner hangers and plugs all use slips and cones, the cones providing an angled surface for the slip members to become wedged between a wellbore wall and the tubular string and ensuring that the weight of the string is supported.

New oil discoveries require drilling deeper wells, which means that spiders and elevators must support heavier pipe strings without crushing the pipe. This slip-crushing issue limits the length of the pipe string that can be suspended by the slips. Uneven axial distribution of the radial slip load on a pipe string exacerbates the slip crushing issue. Therefore, there exists a need in the art for a slip assembly or a spider which more evenly distributes the stress on a tubular along the contact length of the tubular.

SUMMARY OF THE INVENTION

Embodiments of the present invention generally relate to an apparatus for supporting a tubular that more evenly distributes stress along the contact length of a tubular than prior art designs. In one embodiment, an apparatus for supporting a tubular is provided. The apparatus includes a slip member movable along a supporting surface in order to wedge the slip member between the tubular to be retained and the supporting surface. The contact surface between the slip member and the supporting surface is designed whereby an upper portion of the gripping surface of the slip member will initially contact the tubular, thereby distributing the forces generated by the weight of the tubular in a more effective manner.

In another embodiment, an apparatus for supporting a tubular is provided. The apparatus includes a bowl having a longitudinal opening extending therethrough and an inner surface for receiving a gripping member. The inner surface of the bowl is inclined at an angle $A_b$ relative to a longitudinal axis of the tubular. The gripping member is movable along the surface of the bowl for engaging the tubular and has an outer surface inclined at an angle $A_s$ relative to the longitudinal axis of the tubular. $A_s$ is greater than $A_b$.

In another embodiment, an apparatus for supporting a tubular is provided. The apparatus includes a bowl having a longitudinal opening extending therethrough and an inner surface for receiving a gripping member. The gripping member is movable along the surface of the bowl for engaging the tubular. The gripping member includes a die having teeth for engaging the tubular and disposed along a length of the gripping member. The die has a tapered thickness.

In another embodiment, an apparatus for supporting a tubular is provided. The apparatus includes a bowl having a longitudinal opening extending therethrough and an inner surface for receiving a gripping member. The gripping member is movable along the surface of the bowl for engaging the tubular. The apparatus further includes means for distributing stress substantially evenly along a length of the tubular in contact with the gripping member.

In another embodiment, an apparatus for supporting a tubular is provided. The apparatus includes at least one slip moveable along a surface of a support and having a first surface and an opposite gripping surface. The apparatus further includes a die having teeth for engaging the tubular, the die disposed in a slot formed in the gripping surface. The apparatus further includes the support, wherein: the first surface and the support surface are configured so that the gripping member will wedge between the support and the tubular, and the die and the slot are configured so that the die may rotate within the slot to facilitate engagement with the tubular.

In another embodiment, a method for manufacturing an apparatus for supporting a tubular is provided. The method includes providing the apparatus, including: at least one slip moveable along a surface of a support and having a first surface and an opposite gripping surface for engaging the tubular; and the support, wherein: the first surface and the support surface are configured so that the gripping member will wedge between the support and the tubular, and the apparatus is configured so that an upper portion of the gripping surface will engage the tubular before the remainder of the gripping surface engages the tubular. The method further includes using the apparatus as a spider, elevator, liner hanger, plug, or gripping apparatus of a top drive casing make up unit.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 4A is an isometric view of a slip. FIG. 4B is an isometric view of a bowl section.

DETAILED DESCRIPTION

Figure 1:
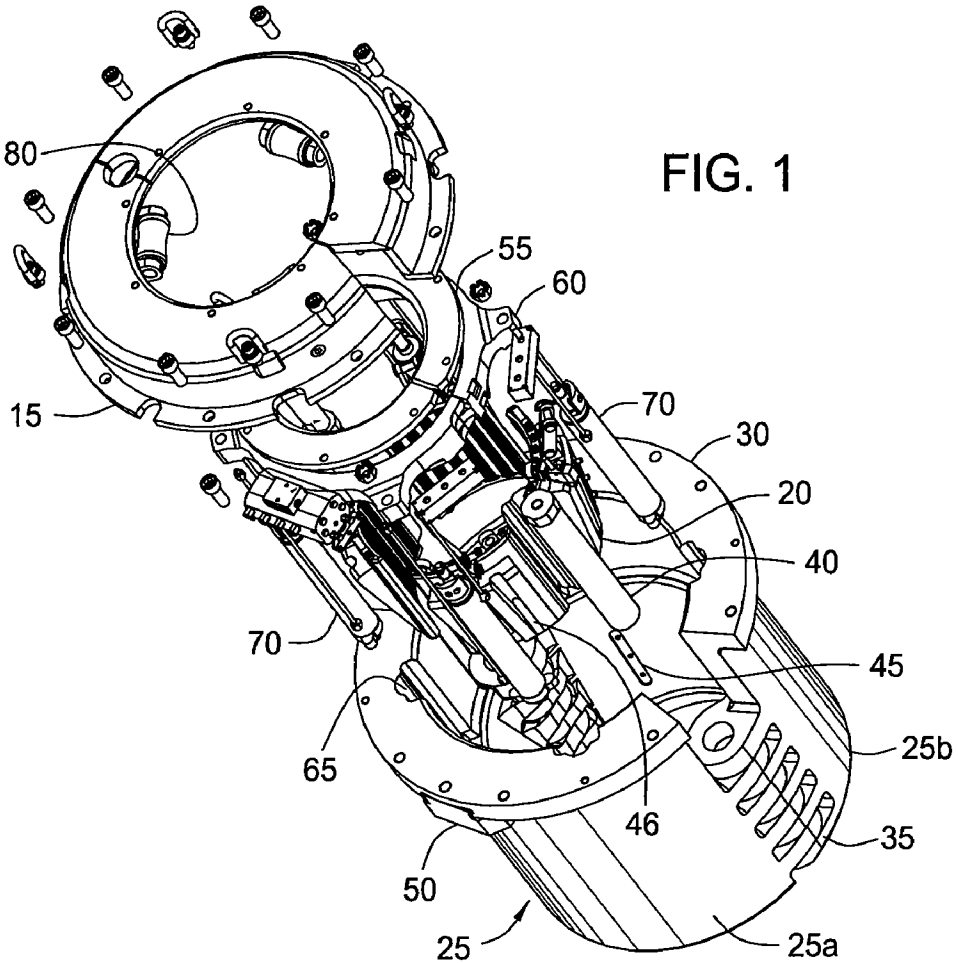
FIG. 1 is an isometric view of a gripping apparatus, according to one embodiment of the present invention.

FIG. 1 is an isometric view of a gripping apparatus, according to one embodiment of the present invention. As shown, the gripping apparatus is a flush mounted spider 5 disposable within a rotary table (not shown). Alternatively, the spider 5 may be fitted for use in an elevator. Additionally, embodiments of the invention can be utilized in any well known apparatus that is dependent upon a slip member and a supporting surface, like a cone to retain the weight of a tubular string in a wellbore or at the surface of a well. Additionally, embodiments of the invention can be utilized in a top drive system used for drilling with casing. More specifically, embodiments can be used in a top drive casing make up system that grips the casing either by the inside or outside of the casing.

The spider 5 includes a body, i.e. bowl 25, for housing one or more gripping members, i.e. slips 20, and a cover assembly 15 for the bowl 25. The bowl 25 of the spider 5 is formed by pivotally coupling two sections 25*a,b* using one or more connectors, preferably hinges 35 formed on both sides of each body section, used to couple the two body sections together. Alternatively, the body sections 25*a,b* may be hinged on one side and selectively locked together on the other side. A hole is formed through each hinge 35 to accommodate a pin 40 (only one shown) to couple the bowl sections 25*a,b* together.

The bowl 25 of the spider 5 includes one or more guide keys 45 (only one shown) for guiding the axial movement of a slip 20. Each guide key 45 mates with a guide slot 46 formed longitudinally on the outer surface of the slip 20. In this manner, the guide key 45 may maintain the path of a moving slip 20. Furthermore, the guide key 45 prevents the slip 20 from rotating in the bowl 25 as it moves axially along the bowl 25. Because the slip 20 cannot rotate within the bowl 25, the spider 5 may be used as a back up torque source during the make up or break out of pipe connections.

A flange 30 is formed on an upper portion of each of the bowl sections 25*a,b* for connection to the cover assembly 15. An abutment, i.e. block 50 (only one shown), is attached to a lower portion of each flange 30 of the bowl sections 25*a,b*. The blocks 50 are designed to mate with slots formed in the rotary table (not shown). The blocks 50 allow torque to be reacted between the spider 5 and the rotary table. As a result, the spider 5 is prevented from rotating inside the rotary table when it is used as a back up torque source during the make up or break out of pipe connections.

The spider 5 includes a leveling ring 55 for coupling the slips 20 together and synchronizing their vertical movement. The leveling ring 55 includes one or more guide bearings 60 extending radially from the leveling ring 55. Preferably, the leveling ring 55 has four guide bearings 60 (three are shown) equally spaced apart around the circumference of the leveling ring 55. For each guide bearing 60, there is a corresponding guide track 65 formed on the inner wall of the upper portion of the bowl 25. The guide track 65 directs the vertical movement of the leveling ring 55 and prevents the leveling ring 55 from rotating. Furthermore, the guide track 65 helps to center a tubular 90 (see FIG. 2) inside the spider 5 and provides better contact between the slips 20 and the tubular.

A piston and cylinder assembly 70 is attached below each of the guide bearings 60 and is associated with a respective slip 20. The slips 20 will be disposed on a surface of the bowl 25 and will be moved along the bowl 25 by the piston and cylinder assembly 70. An outer surface of each of the slips 20 is inclined and includes a guide slot 46 for mating with the respective guide key 45 of the bowl 25. During operation, the piston and cylinder assembly 70 may lower the slip 20 along the incline of the bowl 25. In turn, the incline directs the slip 20 radially toward the center of the spider 5, thereby moving the slip 20 into contact with the tubular 90. To release the pipe, the piston and cylinder 70 is actuated to move the slip 20 up the incline and away from the pipe.

The cover assembly 15 includes two separate sections, each attached above a respective bowl section 25*a,b*. The sectioned cover assembly 15 allows the bowl sections 25*a,b* of the spider 10 to open and close without removing the cover assembly 15. The sections of the cover assembly 15 form a hole whose center coincides with the center of the body 10. The cover assembly 15 includes one or more guide rollers 80 to facilitate the movement and centering of the tubular 90 in the spider 5. Preferably, the guide rollers 80 are attached below the cover assembly 15 and are adjustable. The guide rollers 80 may be adjusted radially to accommodate tubulars of various sizes. Alternatively, instead of guide rollers 80, an adapter plate (not shown) having a hole sized for a particular tubular may be attached to each section of the cover assembly 15 to facilitate the movement and centering of the tubular.

Figure 1A:
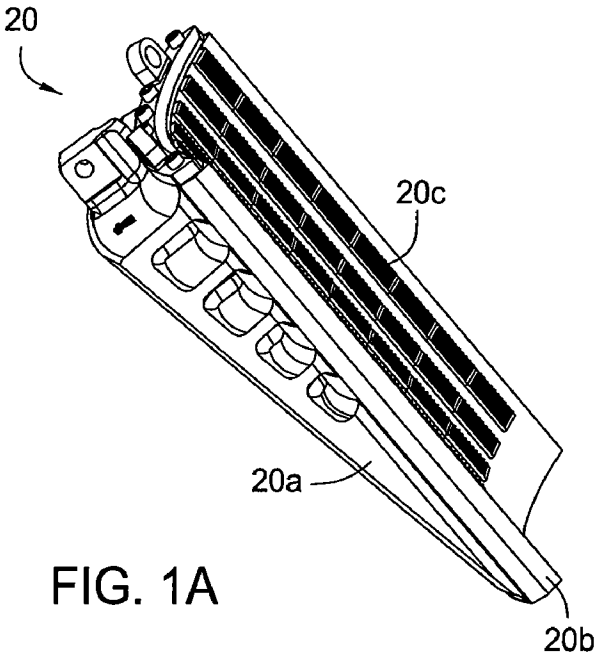
FIG. 1A is an isometric view of one of the slips used in the spider of FIG. 1.

FIG. 1A is an isometric view of one of the slips 20 used in the spider 5. The slip 20 includes an outer member 20*a* having an inclined outer surface which corresponds with an inclined inner surface of the bowl 25. Coupled to the outer member 20*a* is an inner member 20*b* which has a curved inner surface to accommodate the tubular 90. One or more hardened metal dies 20*c* having teeth for engaging the tubular 90 are coupled to an inner surface of the inner member 20*b*.

In operation, the spider 5 is flush mounted in rotary table. Before receiving the tubular 90, the guide rollers 80 are adjusted to accommodate the incoming tubular. Initially, the slips 20 are in a retracted position on the bowl 25. After the tubular 90 is in the desired position in the spider 5, the piston and cylinder assembly 70 is actuated to move the slips 20 down along the incline of the bowl 25. The slips 20 are guided by the guide keys 45 disposed on the bowl 25. The incline causes the slips 20 to move radially toward the tubular 90 and contact the tubular. Thereafter, the make up/break up operation is performed. To release the slips 20 from the tubular 90, the piston and cylinder assembly 70 is actuated to move the slips 20 up along the incline, thereby causing the slips 20 to move radially away from the tubular.

Figure 2:
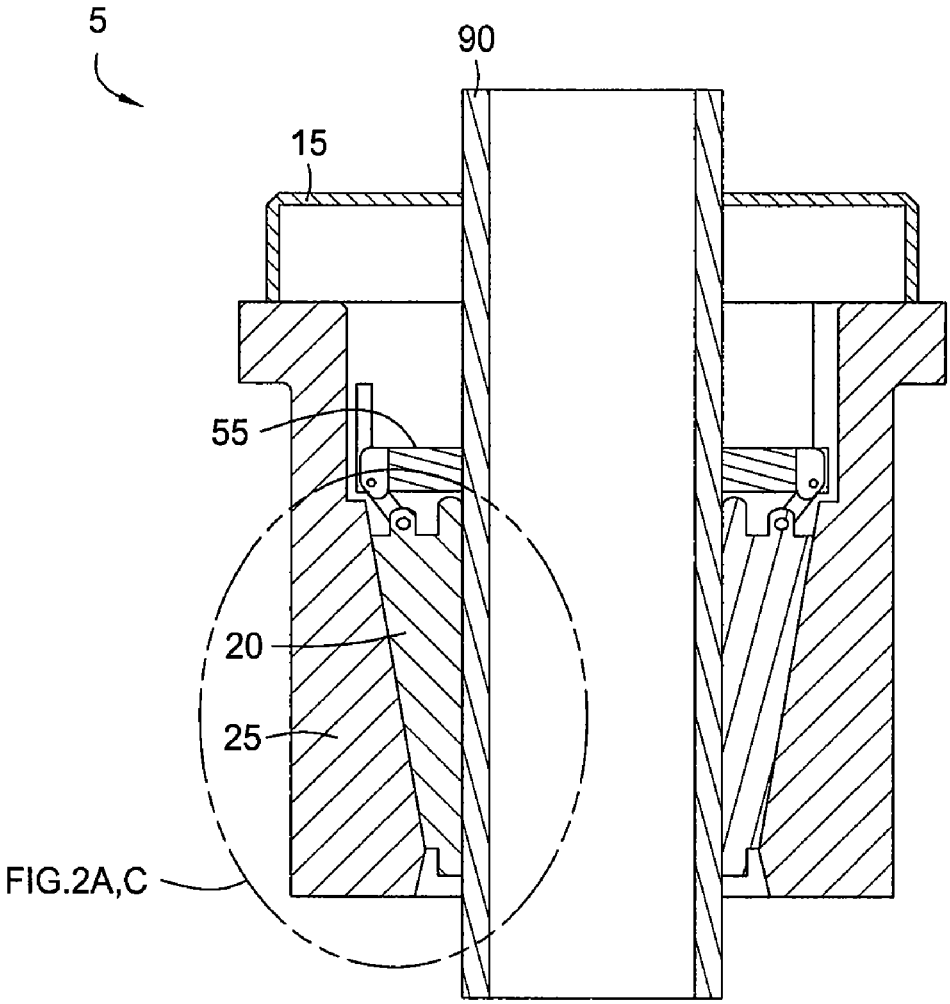
FIG. 2 is a simplified sectional view of the spider of FIG. 1.
Figure 2B:
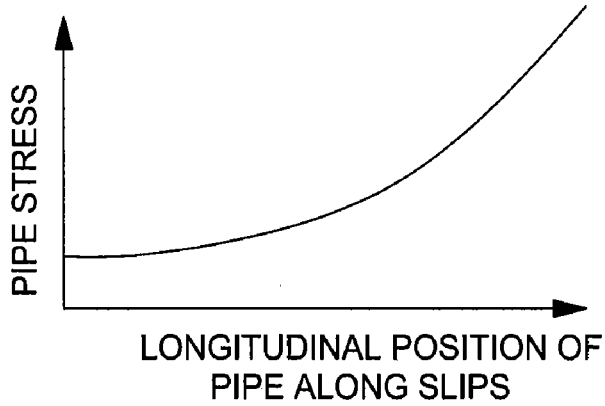
FIG. 2B (PRIOR ART)
FIGS. 2B and 2D are plots of pipe stress versus longitudinal position of the tubular along the slips in a prior art spider and a spider according to one embodiment of the present invention, respectively.
Figure 2A:
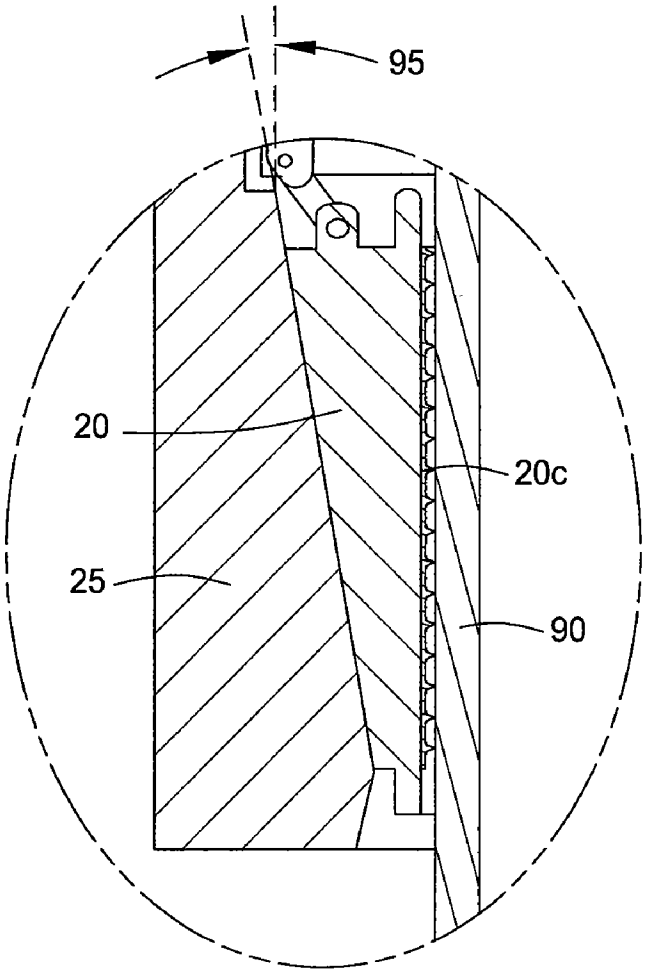
FIG. 2A (PRIOR ART)
FIGS. 2A and 2C are details of FIG. 2 showing inclination angles of each slip and the bowl in a prior art spider and a spider according to one embodiment of the present invention, respectively.
Figure 2D:
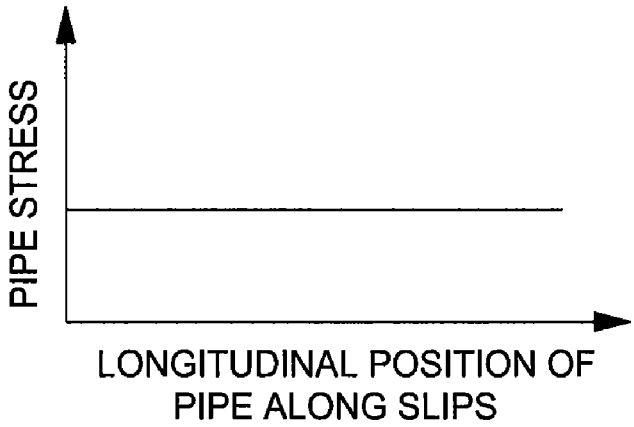
Figure 2C:
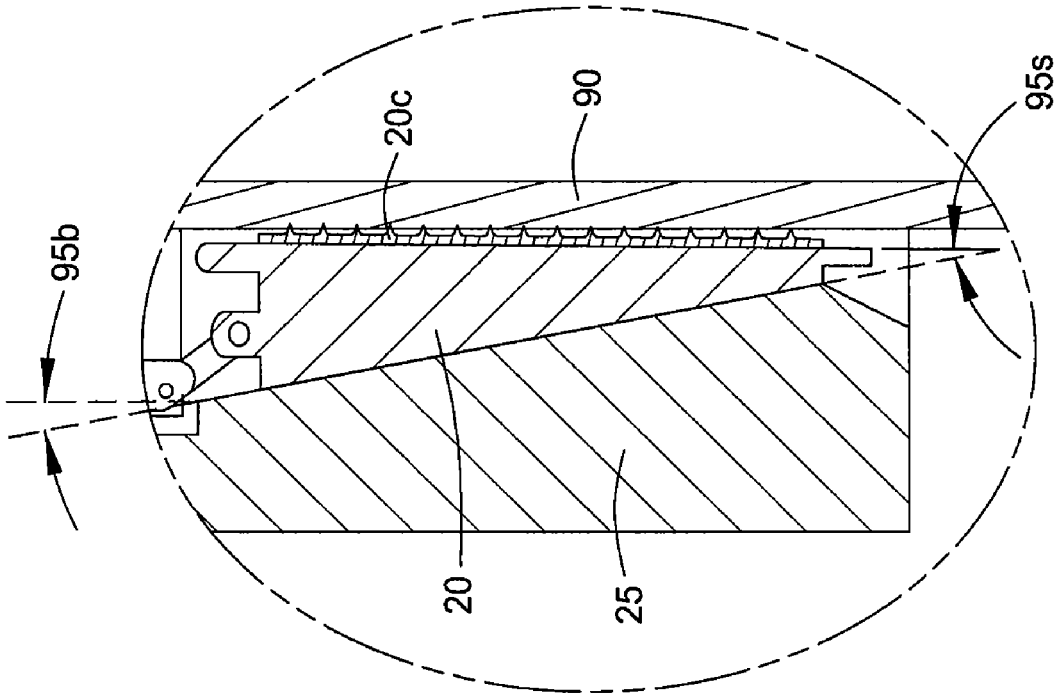

FIG. 2 is a simplified sectional view of the spider 5. The slips 20 of spider 5 are shown engaging the tubular 90 which is part of a string of tubulars. FIGS. 2A and 2C are details of FIG. 2 showing inclination angles, relative to a longitudinal axis of the tubular 90, of each slip 20 and the bowl 25 in a prior art spider and the spider 5, respectively. FIGS. 2B and 2D are plots of pipe stress versus longitudinal position of the tubular 90 along the slips 20 in a prior art spider and the spider 5, respectively.

FIG. 2A shows that an inclination angle 95 is the same for both the slips and the bowl. FIG. 2B shows the resulting stress distribution along the length of the pipe in contact with the slips. Engineering calculations and finite element analysis show that the stress is concentrated on the lower section of the slips that are engaged with the tubular. This stress concentration is caused by the combination of radial stress that is generated by the slips engaging the tubular with axial stresses produced by the weight of the string. Thus, the stress distribution is non-uniform and the stress increases towards a lower end of the tubular 90.

FIG. 2C shows a design that more evenly distributes the stress distribution along the length of the tubular 90 in contact with the dies 20*c* of the slips 20. Each slip 20 has an inclination angle 95*s* that is greater than an inclination angle 95*b* of the bowl. Preferably, the difference between slip angle 95*s* and bowl angle 95*b* is less than 1 degree, more preferably less than one-quarter of a degree, and most preferably less than or equal to about one-eighth of a degree. This difference results in an upper portion of each of the dies 20*c* contacting the tubular 90 before the rest of each of the dies.

As the weight of the tubular 90 is transferred to the spider 5, the weight of the tubular will cause the upper portions of the dies 20*c* to locally deform or penetrate the outer surface of the tubular, thereby allowing the lower portions of the dies 20*c* to contact the tubular. This penetration causes more of the radial force, generated by the interaction of the slips 20 with the bowl 25, to be exerted on the upper portion of the tubular 90 while allowing the tensile force, generated by the weight of the string, to be exerted on the lower portion of the tubular 90. FIG. 2D shows the resulting stress distribution on the pipe is uniform or substantially uniform and the stress is substantially less than the maximum stress of the prior art configuration. The result is that for a given tubular 90, the spider 5 may handle more weight or a longer string of tubulars before crushing the tubular than the prior art design.

According to an alternative embodiment (not shown) of the present invention, an outer surface of each slip 20 may be curved instead of inclined so that an upper portion of each of the dies 20*d* contacting the tubular 90 before the rest of each of the dies 20*d*, thereby equally or substantially equally distributing the stress along the tubular 90. Preferably, the outer surface is concave.

Figure 3:
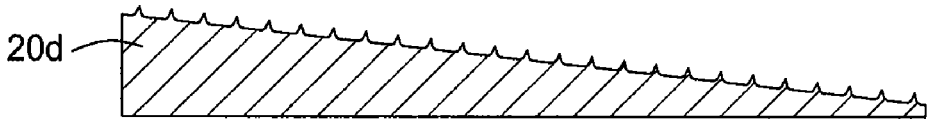
FIG. 3 is a sectional view of a die according to an alternative embodiment of the present invention.

FIG. 3 is a sectional view of a die 20*d* according to an alternative embodiment of the present invention. Instead of the slip angle 95*s* being greater than the bowl angle 95*b*, the thickness of the die 20*d* increases towards an upper end of each of the slips 20. As with the embodiment shown in FIGS. 1 and 2C, using the dies 20*d*, in place of the mismatched angles 95*b,s*, would result in an upper portion of each of the dies 20*d* contacting the tubular 90 before the rest of each of the dies 20*d*, thereby equally or substantially equally distributing the stress along the tubular 90.

Figure 4B:
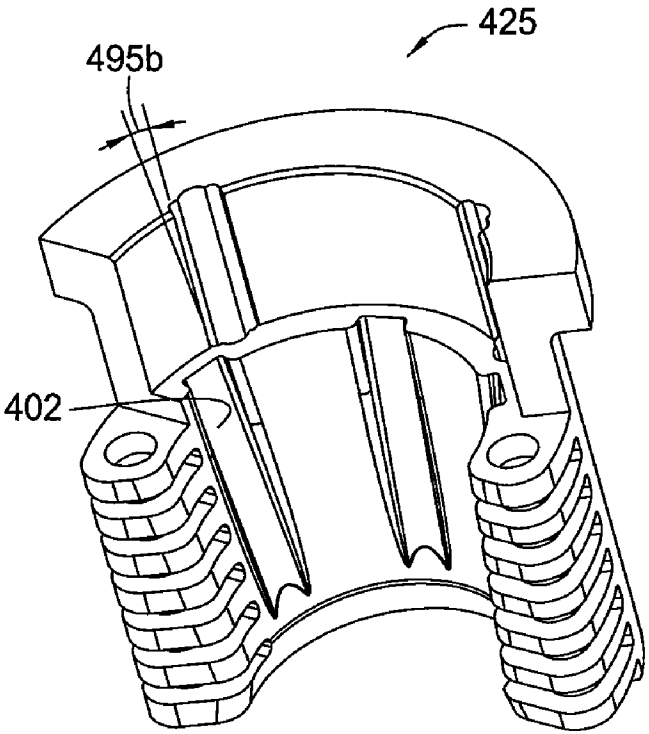
FIGS. 4A and 4B are various views of another alternative embodiment of the present invention.
Figure 4A:
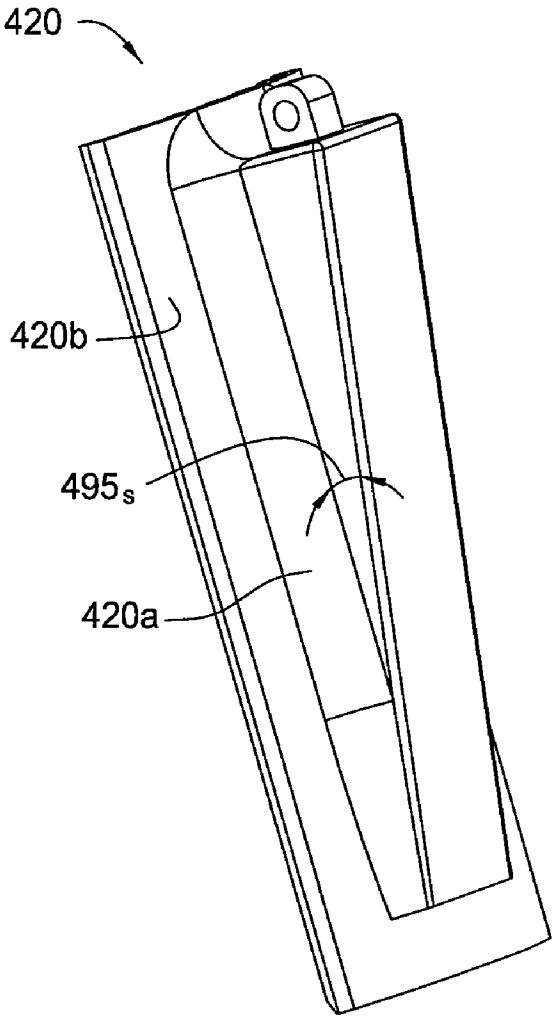

FIGS. 4A and 4B are various views of another alternative embodiment of the present invention. FIG. 4A is an isometric view of a slip 420. FIG. 4B is an isometric view of a bowl section 425. The slip 420 includes an outer member 420*a*. Coupled to the outer member 420*a* is an inner member 420*b* which has a curved inner surface (not shown, see member 20*b* shown in FIG. 1A) to accommodate the tubular 90. Dies of the slip 420 are also not shown; however, they may be similar to the dies 20*c* shown in FIG. 1A. The bowl section 425 includes a plurality of slots 402 formed in an inner surface thereof, each of which will receive a slip 420. The outer member 420*a* has an inclined outer surface which corresponds with an inclined facing surface of each of the slots 402.

Similar to the embodiments shown in FIGS. 1 and 2C, the outer surface of the outer member 420*a* has an inclination angle 495*s* that is greater than an inclination angle 495*b* of the slots 402, thereby equally or substantially equally distributing the stress along the tubular 90. The difference between this embodiment and that of FIGS. 1 and 2C is that the outer surface of the outer member 420*a* is flat or substantially flat along a circumferential direction because of the slots 402, which are also flat or substantially flat in a circumferential direction, whereas the outer surface of the outer member 20*a* is circumferentially curved to accommodate the circumferential curvature of the bowl 25.

According to another alternative embodiment (not shown) of the present invention, the height of the die teeth may vary along the length of the die so that the teeth on an upper portion of each of the dies contact the tubular before the teeth on the rest of each of the dies, thereby equally or substantially equally distributing the stress along the tubular.

Figure 5A:
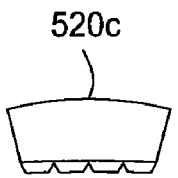
FIG. 5A is a top view of a die, a plurality of which is received by the slip.
Figure 5:
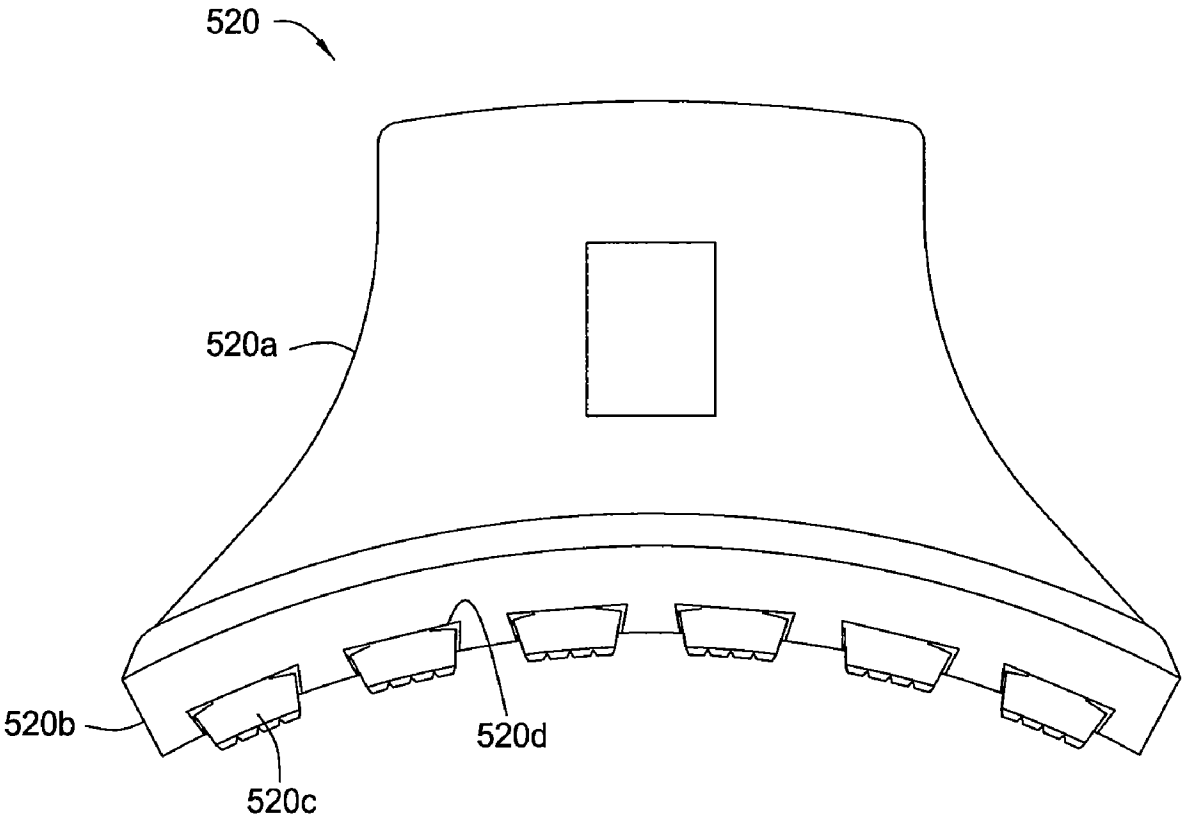
FIG. 5 is a top view of a slip according to another alternative embodiment of the present invention.

FIG. 5 is a top view of a slip 520 according to another alternative embodiment of the present invention. FIG. 5A is a top view of a die 520*c*, a plurality of which is received by the slip 520. Formed in an inner surface of the inner member 520*b* is a plurality of slots 520*d*. Received in each of the slots 520*d* is one of the dies 520*c*. An inner surface of each die 520*c* is rounded so that the dies may rotate slightly within the slots 520*d* to improve gripping of the tubular 90, especially for tubulars 90 with irregular cross sections. Alternatively, a facing surface of each slot 520*d* may be rounded instead of the inner surface of each die 520*c*. This rounded die 520*c* or slip slot 520*d* embodiment may be implemented in the embodiments shown in FIGS. 1 and 2C, 3, and 4.

Figure 6B:
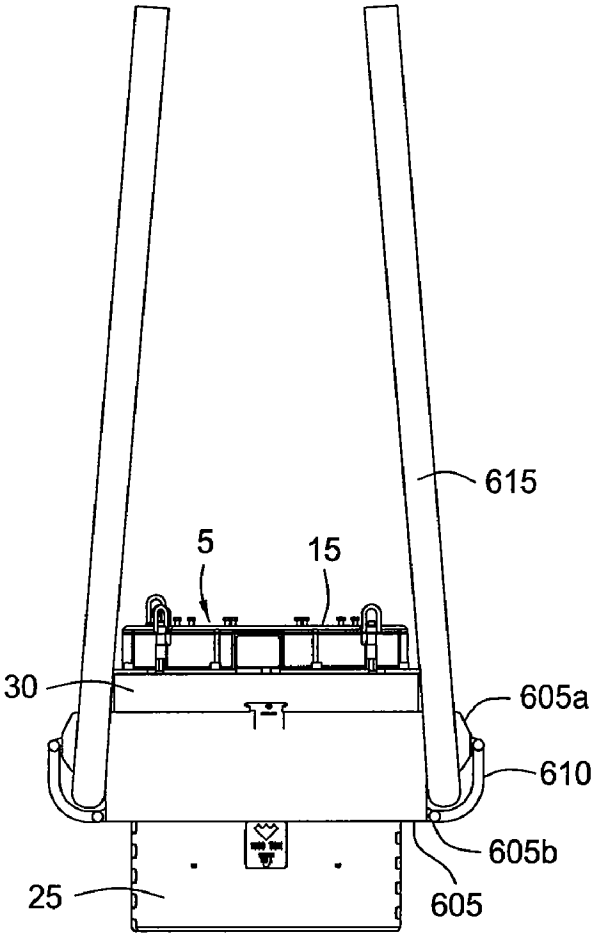
FIG. 6B is a front view of FIG. 6A.
Figure 6A:
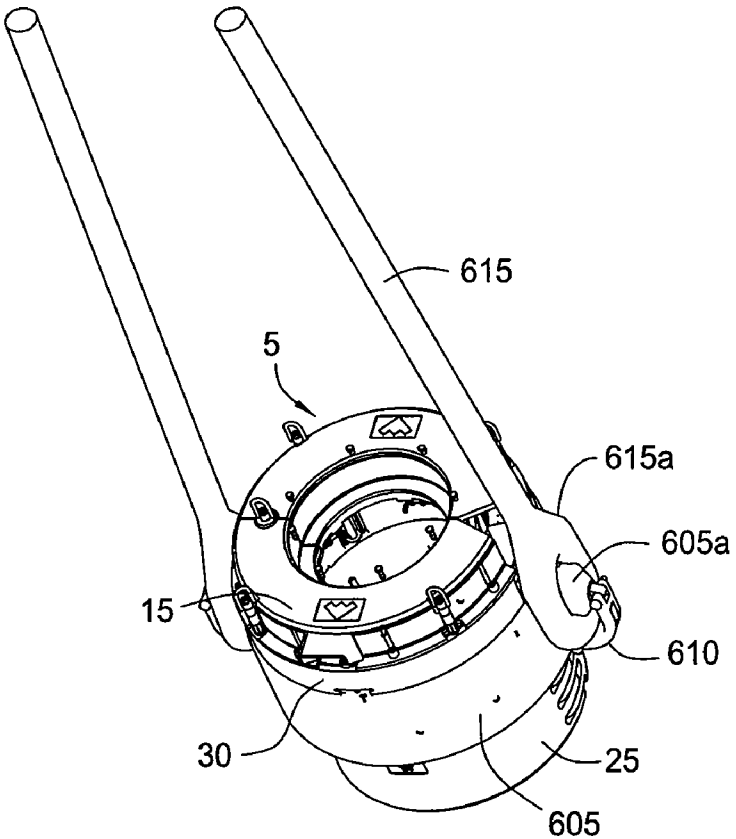
FIG. 6A is an isometric view of the spider of FIG. 1 fitted with an elevator ring and bails for use with a top drive system or other hoisting device.

FIG. 6A is an isometric view of the spider 5 of FIG. 1 fitted with an elevator ring 605 and bails 615 for use with a top drive system (not shown) or other hoisting device. FIG. 6B is a front view of FIG. 6A. The blocks 50 have been removed from the flanges 30. The elevator ring slides over the bowl 25 from the bottom side until it abuts the flange 30. The elevator ring has a pair of upper 605*a* and lower 605*b* brackets formed thereon. Each bracket has a hole for receiving a connector, such as a bolt. The upper brackets 605*a* are formed to each receive a loop 615*a* of each of the bails 615. A "J" shaped bracket 610 is then coupled to each pair of upper 605*a* and lower 605*b* brackets by bolts to secure each loop 615*a* in place. The bails 615 are then attached to a body of a top drive system, traveling block, or other hoisting device.

While the foregoing is directed to embodiments of the present invention, other and further embodiments of the invention may be devised without departing from the basic scope thereof, and the scope thereof is determined by the claims that follow.

The invention claimed is:

1. An apparatus for supporting a tubular, comprising:
- a support member having a longitudinal opening extending therethrough and an inclined inner surface;
- a gripping member having an inclined outer surface that is movable along the inner surface of the support member; and
- a die coupled to the gripping member and configured such that an upper portion of the die penetrates an outer surface of the tubular more than the remainder of the die when the gripping member is moved to engage and support the tubular.

2. The apparatus of claim 1, wherein the die has a tapered thickness so that the upper portion of the die will engage the tubular before the remainder of the die engages the tubular.

3. The apparatus of claim 1, wherein a stress distribution of the die on a length of the tubular is substantially uniform.

4. The apparatus of claim 1, wherein the die is disposed in a slot formed in the gripping member.

5. The apparatus of claim 4, wherein the die and the slot are configured so that the die may rotate within the slot to facilitate engagement with the tubular.

6. The apparatus of claim 4, wherein the die includes a rounded surface that contacts a flat surface of the slot so that the die may rotate within the slot.

7. The apparatus of claim 1, wherein the die includes a plurality of teeth disposed along the length of the die.

8. The apparatus of claim 7, wherein a height of the plurality of teeth vary along the length of the die so that the upper portion of the die contacts the tubular before the remainder of the die.

9. The apparatus of claim 1, further comprising a ring coupled to a flange of the bowl, the ring having brackets for coupling to bails.

10. The apparatus of claim 1, wherein a slot is formed in the inner surface of the support member and a portion of the gripping member is disposed in the slot.

11. The apparatus of claim 1, wherein the inclined outer surface of the gripping member is movable along the inner surface of the support member to move the gripping member into engagement with the tubular, and wherein the upper portion of the die deforms the tubular when moved into engagement with the tubular.

12. The apparatus of claim 1, wherein the inclined outer surface of the gripping member and the inner surface of the support member are circumferentially curved.

13. The apparatus of claim 1, wherein the inclined outer surface of the gripping member and the inner surface of the support member are circumferentially flat.

14. The apparatus of claim 7, wherein the apparatus is configured for use as a spider, elevator, or liner hanger.

15. An apparatus for supporting a tubular, comprising:
- a bowl having a longitudinal opening extending therethrough and an inner surface;
- a slip movable along the inner surface of the bowl; and
- a die coupled to the slip, the die having teeth for engaging the tubular and a tapered thickness along a length of the die, wherein an upper portion of the die is configured to engage the tubular before the remainder of the die engages the tubular when the slip is moved to engage and support the tubular.

16. The apparatus of claim 15, wherein a stress distribution of the die on a length of the tubular is substantially uniform.

17. The apparatus of claim 15, wherein the die is disposed in a slot formed in the slip.

18. The apparatus of claim 17, wherein the die and the slot are configured so that the die may rotate within the slot to facilitate engagement with the tubular.

19. The apparatus of claim 17, wherein the die includes a rounded surface that contacts a flat surface of the slot so that the die may rotate within the slot.

20. The apparatus of claim 15, wherein the die includes a plurality of teeth disposed along a length of the die.

21. The apparatus of claim 20, wherein a height of the plurality of teeth vary along the length of the die so that the upper portion of the die contacts the tubular before the remainder of the die.

22. The apparatus of claim 15, further comprising a ring coupled to a flange of the bowl, the ring having brackets for coupling to bails.

23. The apparatus of claim 15, wherein a slot is formed in the inner surface of the bowl and a portion of the slip is disposed in the slot.

24. The apparatus of claim 15, wherein the slip is movable along the inner surface of the bowl to move the slip and therefore the die into engagement with the tubular so that the upper portion of the die deforms or penetrates the tubular to allow the remainder of the die to contact the tubular.

25. The apparatus of claim 15, wherein the apparatus is configured for use as a spider, elevator, or liner hanger.

26. The apparatus of claim 15 wherein an outer surface of the slip and the inner surface of the bowl are circumferentially curved.

27. The apparatus of claim 15, wherein an outer surface of the slip and the inner surface of the bowl are circumferentially flat.

28. A method for supporting a tubular, comprising:
- inserting the tubular into a gripping apparatus, wherein the gripping apparatus comprises:
  - a support having a support surface;
  - a slip movable along the support surface; and
  - a die coupled to the slip for engaging the tubular;
- moving the slip along the support surface toward the tubular, thereby moving an upper portion of the die into engagement with the tubular; and thereafter
- engaging the tubular with the remainder of the die as the slip moves toward the tubular to support the tubular.

29. The method of claim 28, wherein the die has a tapered thickness so that the upper portion of the die engages the tubular before the remainder of the die engages the tubular.

30. The method of claim 28, further comprising using the gripping apparatus as a spider, elevator, or liner hanger.

31. The method of claim 10, further comprising providing a substantially uniform stress distribution along a length of the tubular using the die.

32. The method of claim 28, further comprising deforming or penetrating an outer surface of the tubular with the upper portion of the die more than the remainder of the die.

* * * * *

UNITED STATES PATENT AND TRADEMARK OFFICE

CERTIFICATE OF CORRECTION

PATENT NO. : 8,020,627 B2
APPLICATION NO. : 12/688674
DATED : September 20, 2011
INVENTOR(S) : Shahin et al.

It is certified that error appears in the above-identified patent and that said Letters Patent is hereby corrected as shown below:

In the Claims:

Column 7, Claim 7, Line 41, please delete "the" before length and insert --a-- therefor;

Column 7, Claim 9, Line 47, please delete "bowl" and insert --support member-- therefor;

Column 7, Claim 14, Line 63, please delete "7" and insert --1-- therefor;

Column 8, Claim 20, Line 20, please delete "a" and insert --the-- therefor;

Column 8, Claim 31, Line 58, please delete "10" and insert --28-- therefor.

Signed and Sealed this
Sixth Day of March, 2012

David J. Kappos

David J. Kappos
*Director of the United States Patent and Trademark Office*